United States Patent [19]

King

[11] 4,350,127

[45] Sep. 21, 1982

[54] TORQUE SPRING ADJUSTMENT MECHANISM

[75] Inventor: Dennis M. King, Peoria, Ill.

[73] Assignee: Caterpillar Tractor Co., Peoria, Ill.

[21] Appl. No.: 247,566

[22] Filed: Mar. 25, 1981

[51] Int. Cl.[3] ..... F02D 31/00

[52] U.S. Cl. ..... 123/364; 123/367; 123/343

[58] Field of Search ..... 123/343, 364, 367

[56] References Cited

U.S. PATENT DOCUMENTS

| | | | |
|---|---|---|---|
| 2,708,921 | 5/1955 | Links | 123/367 |
| 2,961,229 | 11/1960 | Parks | 73/513 |
| 3,145,624 | 8/1964 | Parks et al. | 91/366 |
| 3,234,927 | 2/1966 | Cramer, Jr. | 123/367 |
| 3,499,426 | 3/1970 | Bailey | 123/140 |
| 4,265,203 | 5/1981 | Cain et al. | 123/367 |

*Primary Examiner*—Ira S. Lazarus
*Assistant Examiner*—Magdalen Moy
*Attorney, Agent, or Firm*—Phillips, Moore, Weissenberger, Lempio & Majestic

[57] ABSTRACT

Governors for diesel engines use a torque-spring to control the slope torque-rise curve as the rack actuator moves between the balance point and full load position. At present, it is difficult to adjust the torque spring mechanism to obtain the correct amount of rack movement between these positions. In the present invention, a first adjustment screw (33) is engageable with the torque spring (20), a second adjustment screw (34) is engageable with a fixed stop member (24), and a means (40) concurrently moves the first screw (33) in spring-deflecting engagement with the torque spring (20) and moves the second screw (34) towards engagement with the stop member (24) in response to fuel-increasing movement of the rack actuator (12), with further fuel-increasing movement of the rack actuator (12) being prevented by engagement of the second screw (34) with the stop member (24).

10 Claims, 4 Drawing Figures

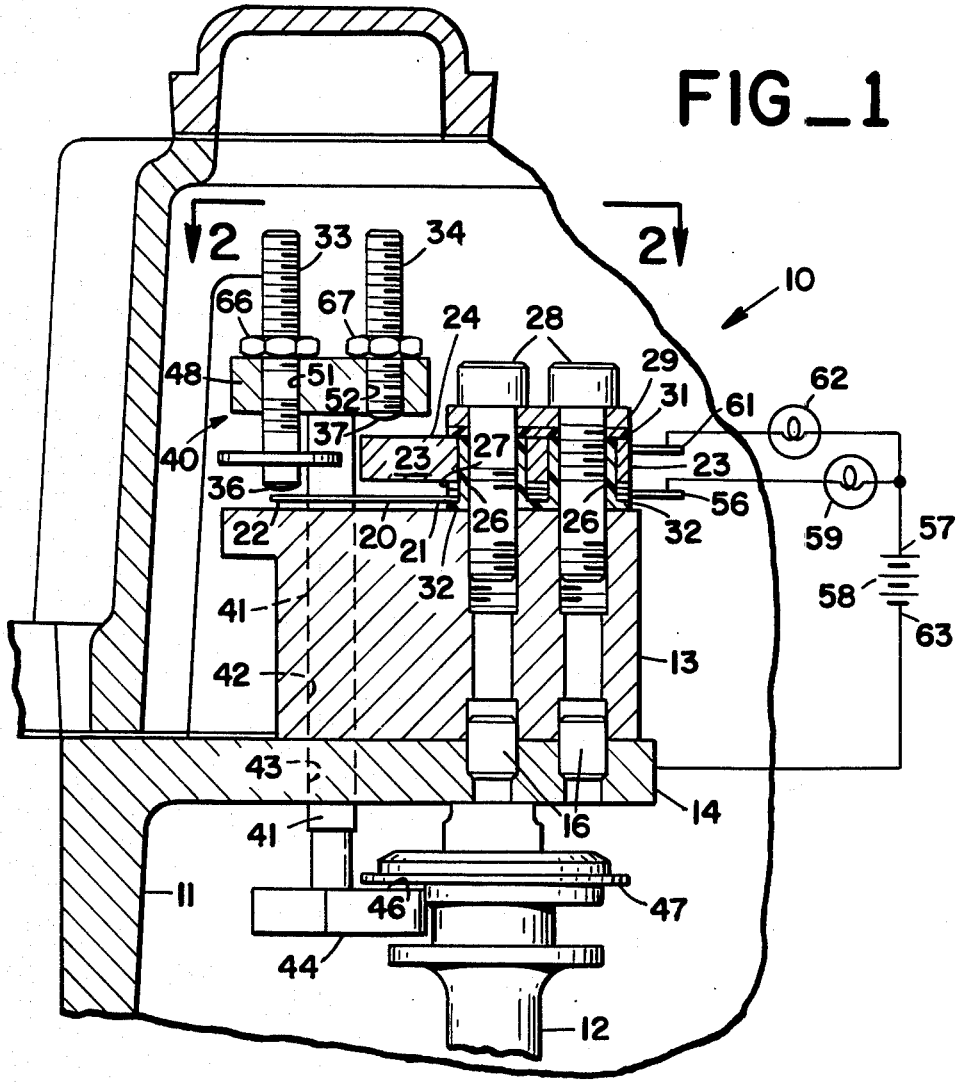
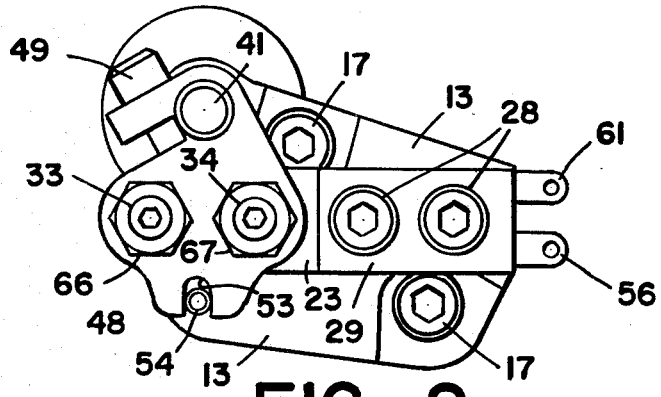
FIG_2

TORQUE SPRING ADJUSTMENT MECHANISM

TECHNICAL FIELD

This invention relates to diesel engine governors and particularly to apparatus for setting the amount of allowable deflection of the torque spring of a governor.

BACKGROUND ART

When operating at its balance point, i.e. at rated horsepower at rated speed, a diesel engine will develop an amount of torque determined by such horsepower and speed. An increase in load will cause the engine speed to decrease. The governor system for the engine will typically function to move the fuel rack of the fuel pump in a fuel increasing direction in response to a decrease in engine speed so that the pump will supply more fuel to the engine (up to a maximum allowable amount). The increased amount of fuel causes the engine to generate more torque to meet the increased load.

Also typically, the slope of the torque curve (engine torque vs. engine speed) is set for the engine system by a torque spring which resists movement of the fuel rack in a fuel increasing direction as the engine speed reduces below rated speed.

A commonly used torque spring arrangement includes a cantilever-mounted spring blade and a full load stop surface parallel thereto. A spring-engaging member movable with the fuel rack actuation engages the spring when the engine is operating at its balance point and causes the spring to deflect relative to its fixed end as the rack actuator moves the rack in a fuel increasing direction in response to a decrease in engine speed. Continued movement of the rack actuator in a fuel increasing direction will cause greater and greater deflection of the torque spring until the torque spring comes into engagement with the full load stop surface. Such engagement prevents further movement of the fuel rack actuator in a fuel increasing direction and thus provides a maximum limit to the amount of fuel which the fuel pump can deliver to the engine.

The amount of rack movement required to move the torque spring from its undeflected position to its fully deflected (and positively stopped) position is normally referred to as "Δ rack." Different engines and applications require different values of Δ rack to produce a desired torque-rise curve.

Currently, spacer members are disposed between the fixed end of the torque spring and the full load stop surface so that the amount of rack is established by the thickness of the spacer members. There are, however, several problems with the use of such spacer members as a determinant for Δ rack.

One problem is that, if a different torque-rise curve is desired, the torque spring assembly must be partially disassembled and a different spacer substituted to provide a different Δ rack. Additionally, a supply of spacer members of different thicknesses must be maintained on hand to enable such different values of Δ rack to be set.

Another problem that occurs results from thickness tolerance of spacer members. During engine assembly, a spacer member of correct nominal size will be installed. Frequently, however, it will be found, when the assembled engine is tested that there is a sufficient spacer thickness variation such that the engine will not meet the torque curve specification. In such case, the engine must again be partially disassembled so that the improperly sized spacer member can be replaced by one of correct thickness.

As a consequence, there is a need for a torque spring arrangement wherein Δ rack can be adjusted and set for an engine independently of the spacer thickness.

Proper operation of a torque spring assembly requires that the member which moves with the rack actuator be just engaged with the torque spring, but without deflection thereof, when the engine is operating at the balance point. Current torque spring assemblies present a problem of determining the correctness of this adjustment.

DISCLOSURE OF THE INVENTION

The present invention is directed to solving one or more of the problems as set forth above.

In one aspect of the invention and in which a governor for an internal combustion engine has a housing, a rack actuator movable in the housing and a torque spring with one end fixed to the housing, a torque spring adjustment mechanism is provided, comprising a first adjustment screw engageable with the free end of the torque spring, a stop member, a second adjustment screw engageable with the stop member, and means for moving the first adjustment screw into spring deflecting engagement with the torque spring in response to fuel-increasing movement of the rack actuator, for concurrently moving the second adjustment screw axially towards the stop member, and for preventing further fuel-increasing movement of the rack actuator upon engagement of the second adjustment screw and stop member.

A further aspect of the invention is that an electrical circuit is provided to indicate when the first adjustment screw is in contact with the torque spring.

The foregoing and other aspects of the invention will become apparent from the following detailed description of the invention when considered in conjunction with the accompanying drawings.

BRIEF DESCRIPTION OF THE DRAWINGS

FIG. 1 is a sectional view of a portion of an engine governor illustrating a torque spring assembly in accordance with the present invention.

FIG. 2 is a view of the torque spring assembly of FIG. 1, as seen from line 2—2 thereof.

DESCRIPTION OF THE PREFERRED EMBODIMENT

Figure 3:
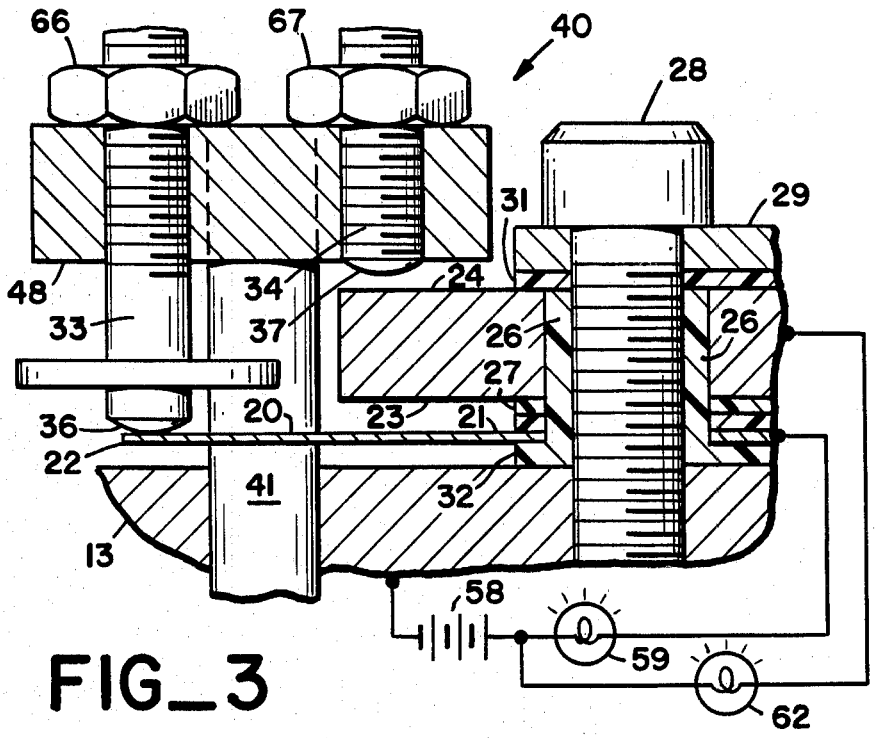
FIG. 3 is a view of a portion of FIG. 1, and in enlarged scale, showing the position of the parts when the balance point adjusting screw is in contact with the undeflected torque spring.

Referring now to the drawings, wherein is illustrated a preferred embodiment of the invention, FIG. 1 illustrates the portion of a governor 10 to which the present invention is directed, the governor 10 having a housing 11 and a rack actuator 12 axially movable in the housing in a fuel-increasing direction and a fuel-decreasing direction (such directions being shown as down and up, respectively, in FIG. 1). The governor 10 will, of course, include a governor spring and flyweights associated with the rack actuator 12 to cause the rack actuator to move the fuel rack of the fuel pump to increase fuel flow to the engine in the event of a decrease in engine speed or to decrease the fuel flow in the event of an increase in engine speed. For purposes of simplicity, such conventional structure is not shown herein.

Governor 10 also includes a mounting block 13, positioned relative to housing web 14 by pilot pins 16 and securely bolted thereto by bolts 17. For purpose of present description, mounting block 13 may thus be regarded as a portion of housing 11.

A torque spring 20, of blade form and of suitable metallic and electrically-conductive spring material, is cantilever mounted in the governor with one end 21 fixed to housing 11 and the other end 22 resiliently deflectable (in a vertical direction as illustrated in FIG. 1) relative to the fixed end.

A full load stop bar 23, having an upper surface 24 functioning as a stop member is also provided.

In accordance with the present invention, and as particularly illustrated herein, torque spring 20 and stop bar 23 have vertical holes therethrough enabling them to fit onto sleeves 26 with one or more spacers 27 disposed between the spring 20 and bar 23. Bolts 28 extend downwardly through top plate 29, spacer 31 and sleeve 26 into threaded engagement with mounting block 13 and securely hold the fixed end 21 of torque spring 20 and stop bar 23 in fixed relation to housing 11. Sleeves 26 and spacer 31 are of suitable insulative material to electrically insulate torque spring 20 and stop bar 23 from housing 11. If desired, spacer 27 may also be of insulative material to electrically insulate torque spring 20 from stop bar 23 as well. Sleeves 26 have lower radial flanges 32 of suitable thickness to support torque spring 20 at an elevation above mounting block 13 so that end 22 of torque spring 20 is free to deflect downwardly.

In further accordance with the invention, first and second axially-adjustable screw members 33 and 34 are provided, screw member 33 having an end 36 engageable with end 22 of torque spring 20 and screw member 34 having an end 37 engageable with stop member 24.

In still further accordance with the invention, a means 40 is provided for moving the first screw member 33 axially and in progressively-increasing, spring-deflecting engagement of the first screw member end 36 with the end 22 of torque spring 20 in response to movement of rack actuator 12 in its fuel increasing direction, for concurrently moving the second screw member 34 axially towards the stop member 24, and for preventing further movement of the rack actuator 12 in its fuel-increasing direction upon engagement of the end 37 of the second screw member 34 and the stop member 24.

As particularly illustrated herein, means 40 includes a shaft 41 mounted in housing 11 for axial movement parallel to the direction of movement of rack actuator 12, shaft 41 extending vertically through bores 42 and 43 in mounting block 13 and housing web 14. Shaft 41 has fixed to its lower end a clasp 44 having an upwardly facing surface 46 engageable with the downwardly facing shoulder 47 which extends radially of rack actuator 12 so that shaft 41 will move downwardly in response to downward movement of rack actuator 12.

A collar 48, functioning herein as a screw holder, is fixed by bolt 49 to the upper end of shaft 41 for unitary vertical movement with the shaft, collar 48 having threaded bores 51 and 52 parallel to shaft 41 in which adjustment screws 33 and 34 are respectively threaded. Rotation of shaft 41 about its axis is prevented by the vertical sliding engagement of the sides of collar slot 53 with the vertical guide pin 54, the latter being fixed to mounting block 13 (FIG. 2).

For test purposes, to be hereinafter described, torque spring 20 may be provided with an integral tab 56 to which terminal 57 of a suitable voltage source, such as battery 58, may be electrically connected through indicator light 59. If stop bar 23 is electrically insulated from torque spring 20, stop bar 23 may also be provided with a tab 61 to which battery terminal 57 may be electrically connected through another indicator light 62. The other battery terminal 63 may be electrically connected to both adjustment screw members 33 and 34 by connection of such terminal 63 to any convenient part of housing 21 which provides an electrical path to the screw members. The indicator lights 59 and 62 provide herein a means for generating a signal in response to flow of electrical current from the voltage source 58 through the first screws member 33 and torque spring 20 and a second signal in response to flow of electrical current through the second screw member 34 and the stop member 24.

The use of the present invention is as follows. After assembly of an engine and governor system, the engine will be tested and adjusted. For such adjustment purposes, battery 58 and indicator lights 59 and 62 will be connected as shown.

Suppose that the engine is to develop rated horsepower at 2200 rpm. The high idle adjustment of the governor (not shown) will be set so that the engine will operate, without load, at a higher speed, for example at 2400 rpm. The load on the engine machine is increased until the engine speed is reduced to 2200 rpm at which speed the high idle is adjusted to move the rack actuator in a fuel-increasing or fuel-decreasing direction, as needed, to the position wherein the proper amount of fuel is delivered to the engine to develop rated horsepower at that speed.

The first, or balance point adjusting screw member 33 is then adjusted so that its end 36 just touches spring 20, as shown in FIG. 3. Such contact is easy to detect, since indicator light 59 will then be energized. With such adjustment made, jam nut 66 is tightened against collar 51 to lock screw member 33 to the collar.

Figure 4:
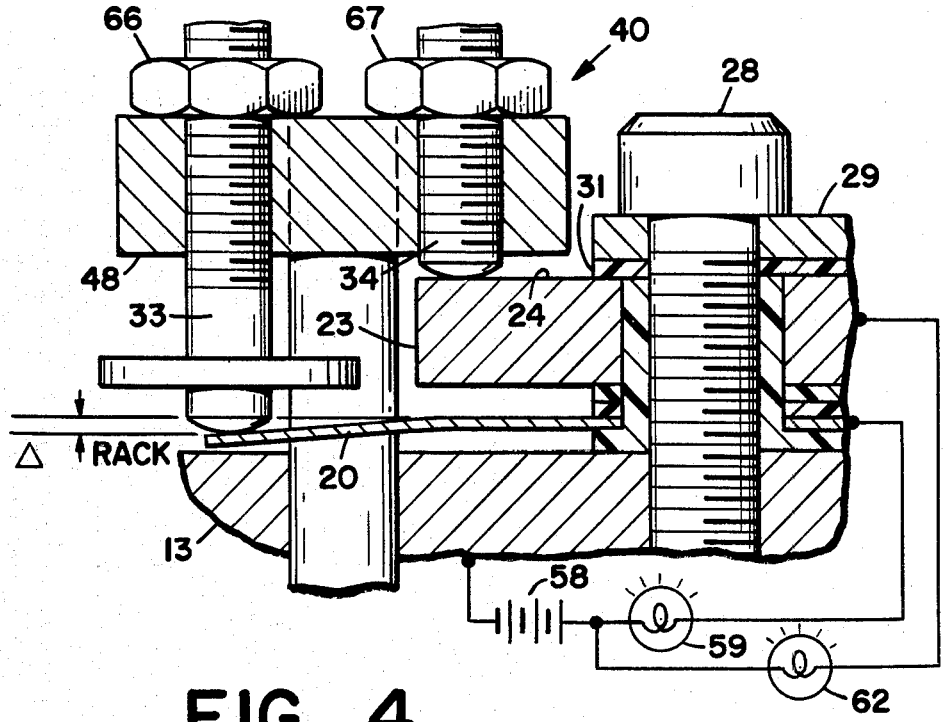
FIG. 4 is similar to FIG. 3 and shows the position of the parts when the rack stop adjusting screw is in engagement with the full load stop bar.

The load on the engine is again increased to reduce the engine speed to a predetermined lower value, for example, to 1400 rpm. As the engine speed decreases, the governor 10 will move fuel rack actuator 12 downwardly in a fuel-increasing direction with shaft 41 and adjustment screw member 33 and 34 moving downwardly therewith. Such movement will cause the first adjustment screw 33 to deflect torque spring 20 and will cause the second adjustment screw 34 to come into contact with stop member 24 (FIG. 4). The latter contact positively stops downward movement of shaft 41 and further movement of rack actuator 12 in a fuel increasing direction. Engagement of the second adjustment screw 34 and stop member 24 is indicated by the illumination of indicator light 62.

The second, or rack stop adjusting screw member 34 is now adjusted up or down in collar 51 as needed, to pull the rack actuator 12 upwardly or allow it to move downwardly, so that the rack actuator is positioned to cause the fuel pump to deliver the amount of fuel to the engine to produce the desired amount of torque at the reduced engine speed. With this adjustment made, jam nut 67 is tightened to lock screw member 34 in adjusted position.

With these adjustments made, the correct amount of $\Delta$ rack, i.e. the amount of rack movement between the undeflected engagement of the first screw member 33 with torque spring 20, illustrated in FIG. 3 and the engagement of the second screw member 34 with the full load stop member 23, illustrated in FIG. 4, will have been provided. The electrical connections of the battery 58 to the torque spring 20 and housing 11 may now be removed.

As is apparent, thickness tolerances in the components mounting the torque spring 20 to the housing do not present problems in setting rack at the proper value, it being essential only that sleeve flanges 32 have sufficient thickness such that the distance from the undeflected free end 22 of the torque spring 20 to the mounting block 13 is greater than the maximum amount of rack to which the governor is to be set.

INDUSTRIAL APPLICABILITY

The present invention has particular utility in diesel engine governors and enables the balance point of torque spring operation to be adjusted independently of the full load rack position. Such adjustment enables the correct value of Δ rack to be obtained, and obtained during engine operation, to meet the desired torque-rise specifications for the engine.

In some instances it may be desired to use two torque springs, operating in conjunction with each other to provide a better regulation of the amount of torque spring force exerted against the rack during movement of the rack from the balance point of torque spring operation to the full load rack position.

For example, in the construction shown in FIGS. 1–4, the full load stop bar could be replaced by a second cantilever-mounted torque spring having a desired spring rate and engageable by screw member 34. In such case, the collar 48 would have a third adjustment screw (not shown) mounted thereon, the third adjustment screw being parallel to screw members 33 and 34 and movable down to engagement with a full load stop member which is fixed relative to mounting block 13. With such an arrangement it is then possible to have one of the torque springs continually deflecting as the rack moves from the balance point to full load position, while the other torque spring is engaged and deflected for only a portion of such rack movement.

I claim:

1. In a governor (10) for an internal combustion engine, said governor (10) having a housing (11), a rack actuator (12) movable in said housing (11) in a fuel-increasing direction and a fuel-decreasing direction, and a torque spring (20) with one end (21) thereof fixed to said housing (11) and a second end (22) resiliently deflectable relative to said first end (11), the improvement comprising:

a first axially-adjustable screw member (33) having an end (36) engageable with said second end (22) of said torque spring (20), a stop member (24), a second axially-adjustable screw member (34) having an end (37) engageable with said stop member (24), means (40) for moving said first screw member (33) axially and in progressively-increasing, spring deflecting engagement of said first screw member end (36) with said second end (22) of said torque spring (20) in response to movement of said rack actuator (12) in its fuel-increasing direction, for concurrently moving said second screw member (34) axially and toward said stop member (24), and for preventing further movement of said rack actuator (12) in said fuel-increasing direction upon engagement of said end (37) of said second screw member (34) and said stop member (24).

2. In a governor (10) as set forth in claim 1, wherein said first screw member (33) and said torque spring (24) are both electrically conductive, the improvement further comprising:

means (26,31) for electrically insulating one of said first screw member (33) and torque spring (20) from said housing (11).

3. In a governor (10) as set forth in claim 2, the improvement further comprising:

a voltage source (58) having two terminals (57,63), one (63) of which is electrically connected to said first screw member (33) and the other (57) which is electrically connected to said torque spring (20), means (59) for generating s signal in response to flow of electrical current from said voltage source (58) through said first screw member (33) and torque spring (20).

4. In a governor (10) as set forth in claim 1, wherein said first and second screw members (33,34) said torque spring (20) and said stop member (24) are all electrically conductive, the improvement further comprising:

means (26,27,31) for electrically insulating said torque spring (20) and said stop member (24) from said housing (11) and from each other.

5. In a governor (10) as set forth in claim 4, the improvement further comprising:

a voltage source (58) having two terminals (57,63), one (57) of which is electrically connected to said first torque spring (20) and to said stop member (24) and the other (63) of which is electrically connected to said first and second screw members (33,34), means (59,62) for generating a first signal in response to flow of electrical current from said voltage source (58) through said first screw member (33) and torque spring (20) and a second signal in response to flow of electrical current form said voltage source (58) through said second screw member (34) and said stop member (24).

6. In a governor as set forth in claim 1 wherein said stop member (24) is fixed to said housing (11) and said means (40) includes:

a shaft (41) mounted in said housing (11) for axial movement parallel to the fuel-increasing direction of movement of said rack actuator (12), a screw holder (48) fixed to said shaft (41) and having first and second threaded bores (51,52) parallel to said shaft (41), said first screw member (33) being threaded in said first bore (51) and said second screw member (34) being threaded in said second bore (52), means (46,47) for moving said shaft (41) axially in response to movement of said rack actuator (12) in its fuel-increasing direction.

7. In a governor (10) as set forth in claim 6, wherein said first screw member (33) and said torque spring (20) are both electrically conductive, the improvement further comprising:

means (26,31) for electrically insulating one of said first screw member (33) and torque spring (20) from said housing (11).

8. In a governor (10) as set forth in claim 7, the improvement further comprising:

a voltage source (58) having two terminals (57,63), one (63) of which is electrically connected to said first screw member (33) and the other (57) which is electrically connected to said torque spring (20), means (59) for generating a signal in response to flow of electrical current from said voltage source (58) through said first screw member (33) and torque spring (20).

9. In a governor (10) as set forth in claim 6, wherein said first and second screw members (33,34) said torque spring (20) and said stop member (24) are all electrically conductive, the improvement further comprising:

means (26,27,31) for electrically insulating said torque spring (20) and said stop member (24) from said housing (11) and from each other.

10. In a governor (10) as set forth in claim 9, the improvement further comprising:

a voltage source (58) having two terminals (57,63), one (57) of which is electrically connected to said first torque spring (20) and to said stop member (24) and the other of which is electrically connected to said first and second screw members (33,34), means (59,62) for generating a first signal in response to flow of electrical current from said voltage source (58) through said first screw member (33) and torque spring (20) and a second signal in response to flow of electrical current from said voltage source (58) through said second screw member (34) and said stop member (24).

* * * * *